US005661957A

United States Patent [19]

Daly

[11] Patent Number: 5,661,957

[45] Date of Patent: Sep. 2, 1997

[54] EXTENDABLE STIRRUP

[76] Inventor: Richard H. Daly, 17605 Black Buble La., Fossil, Oreg. 97830

[21] Appl. No.: 654,213

[22] Filed: May 28, 1996

[51] Int. Cl.[6] ..... B68C 3/00

[52] U.S. Cl. ..... 54/47

[58] Field of Search ..... 54/47, 48

[56] References Cited

U.S. PATENT DOCUMENTS

| | | | |
|---|---|---|---|
| D. 289,453 | 4/1987 | Royer, II | D30/19 |
| 469,957 | 3/1892 | Blood | 54/47 X |
| 706,468 | 8/1902 | Wellman | 54/47 |
| 4,354,338 | 10/1982 | Martin | 54/47 |
| 4,761,938 | 8/1988 | Townsend | 54/47 |
| 4,942,721 | 7/1990 | Von Scoyk . | |
| 5,216,874 | 6/1993 | Farrow | 54/46.1 |
| 5,347,797 | 9/1994 | Seal et al. | 54/46.1 |

FOREIGN PATENT DOCUMENTS 2037139 7/1980 United Kingdom .

*Primary Examiner*—Robert P. Swiatek

[57] ABSTRACT

An extendable stirrup attachable to a conventional stirrup strap of a conventional saddle that has a free end and a throughbore disposed in proximity to the free end of the conventional stirrup strap of the conventional saddle that includes a locking device assembly, a rack assembly, and stirrup assembly. The locking device assembly is attachable to the conventional stirrup strap of the conventional saddle. The rack assembly has a lower end and is lockingly extendable from, and lockingly retractable in, the locking device assembly. And, the stirrup assembly is pivotally mounted to the lower end of the rack assembly, so that the stirrup assembly can be lowered and raised to adjust for different height equestrians.

20 Claims, 4 Drawing Sheets

EXTENDABLE STIRRUP

CROSS REFERENCES TO RELATED APPLICATIONS

This application contains subject matter disclosed in applicant's Disclosure Document No. 292674 filed on Oct. 4, 1991. As such, it is respectfully requested that this Disclosure Document be relied upon and remain a permanent part of the file history during the prosecution of the instant application and during any subsequent action thereof.

BACKGROUND OF THE INVENTION

The present invention relates to a stirrup. More particularly, the present invention relates to an extendable stirrup that includes a stirrup assembly that is spring loaded to a ratchet assembly for adjustably affixing the height of the stirrup.

The operational height of a stirrup often makes it difficult for a rider to step into the stirrup to mount the horse upon which a saddle and the stirrup are positioned.

The youthful or short rider is dependent upon another person to assist or boost the rider, to allow the rider to reach and insert their foot into the stirrup of the saddle. If another person were not available, the rider generally sought a rock, box, stool, fence or other inanimate object to assist them in reaching the stirrup. This practice, through common, is unsafe and less practical, as the horse sensing the reason for being positioned near inanimate object often pulls away foiling the attempt to mount. This procedure is also limited by the availability of the inanimate object.

Further, the enjoyment of horseback riding by small children and youths has always been hindered by the lack of low-cost alterations to standard-sized saddles. A small child cannot properly fit on a standard-sized saddle and use the stirrups. The stirrups on such a saddle cannot be adequately adjusted for small children or youths.

Because horse riders can vary as to their leg length, it is desirable to have the stirrups of a saddle adjustable in distance from the seat of the saddle.

Numerous innovations for stirrups have been provided in the prior art that will be described. Even though these innovations may be suitable for the specific individual purposes to which they address, however, they differ from the present invention in that they do not teach an extendable stirrup that includes a stirrup assembly that is spring loaded to a ratchet assembly for adjustably affixing the height of the stirrup.

FOR EXAMPLE, U.S. Pat. No. Des. 289,453 to Royer, II teaches the ornamental appearance of a positioning brace for saddle stirrups that includes a pair of upwardly-opening horse shoe shaped members that are connected to each other by a slender and substantially rectangular-parallelepiped-shaped connecting member.

ANOTHER EXAMPLE, U.S. Pat. No. 4,354,338 to Martin teaches a fender bending attachment that includes a first leg that has a pair of opposed and abrasive engagement surfaces that are spaced laterally a distance approximately equal to the thickness of the fender of a saddle. A second leg is disposed at an angle of approximately 90 degrees or less to the first leg. A third leg extends rearwardly from the second leg at the distal end thereof.

STILL ANOTHER EXAMPLE, U.S. Pat. No. 4,761,938 to Townsend teaches a stirrup extension that includes an elongated frame constructed of a continuous rod. The frame has a pair of vertically disposed hooks at its upper end thereof. A step is located at the lower end of the of the frame. An arm is secured to the frame and extends vertically upwardly therefrom and terminates in a horizontally disposed U-shaped hook.

YET ANOTHER EXAMPLE, U.S. Pat. No. 4,942,721 to Van Scoyk teaches a stirrup attachment which attaches to a standard-sized saddle and includes a single strap that has stirrups mounted on each end and adjustment buckles to alter the length of the attachment.

STILL YET ANOTHER EXAMPLE, U.S. Pat. No. 5,216,874 to Farrow teaches a leather adjustable stirrup strap that has a plurality of apertures in a first strap portion and plate-like fastener attached to a second strap portion. The fastener has two inverted U-shaped projections for fitting in selected apertures of the plurality of apertures to form the strap into a closed loop or desired length. A locking strap sized to fit under the U-shaped projections is also provided.

YET STILL ANOTHER EXAMPLE, U.S. Pat. No. 5,347,797 to Seal et al. teaches a mounting stirrup that includes a strap and a youth sized stirrup attached to one end thereof by means of a buckle and a loop on the other end thereof.

FINALLY, STILL YET ANOTHER EXAMPLE, GB Patent No. 2 037 139 to Belton, teaches a stirrup strap that has a loop disposed at the top thereof for engaging a saddle iron. The stirrup strap extends downwardly as a single thickness portion whose free end can be hooked through a stirrup and engaged with a hook at an intermediate distance along the strap, in a position of adjustment obtained by choice of one of a row of holes in the free end of the strap for passing over the hook.

It is apparent that numerous innovations for stirrups have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide an extendable stirrup that avoids the disadvantages of the prior art.

ANOTHER OBJECT of the present invention is to provide an extendable stirrup that is simple and inexpensive to manufacture.

STILL ANOTHER OBJECT of the present invention is to provide an extendable stirrup that is simple to use.

YET ANOTHER OBJECT of the present invention is to provide an extendable stirrup whose operational height makes it easy for a rider to step into the stirrup to mount the horse upon which a saddle and the stirrup are positioned.

STILL YET ANOTHER OBJECT of the present invention is to provide an extendable stirrup that eliminates the need for a youthful or short rider to depend upon another person to assist or boost the rider to reach and insert their foot into the stirrup of the saddle.

YET ANOTHER OBJECT of the present invention is to provide an extendable stirrup that eliminates the need for a rider to seek a rock, box, stool, fence or other inanimate object to assist them in reaching the stirrup.

YET STILL ANOTHER OBJECT of the present invention is to provide an extendable stirrup that allows the stirrups of a saddle to be adjustable in distance from the seat of the saddle.

BRIEFLY STATED, STILL YET ANOTHER OBJECT of the present invention is to provide an extendable stirrup that is attachable to a conventional stirrup strap of a conventional saddle that has a free end and a throughbore disposed in proximity to the free end of the conventional stirrup strap of the conventional saddle and includes a locking device assembly, a rack assembly, and stirrup assembly.

YET STILL ANOTHER OBJECT of the present invention is to provide an extendable stirrup wherein the locking device assembly is attachable to the conventional stirrup strap of the conventional saddle.

STILL YET ANOTHER OBJECT of the present invention is to provide an extendable stirrup wherein the rack assembly has a lower end and is lockingly extendable from, and lockingly retractable in, the locking device assembly.

YET STILL ANOTHER OBJECT of the present invention is to provide an extendable stirrup wherein the stirrup assembly is pivotally mounted to the lower end of the rack assembly, so that the stirrup assembly can be lowered and raised to adjust for different height equestrians.

STILL YET ANOTHER OBJECT of the present invention is to provide an extendable stirrup that further includes extendable stirrup mounting apparatus for mounting the extendable stirrup to the conventional stirrup strap of the conventional saddle.

YET STILL ANOTHER OBJECT of the present invention is to provide an extendable stirrup wherein the extendable stirrup mounting apparatus includes a retention ring for maintaining the free end of the conventional stirrup strap of the conventional saddle against the conventional stirrup strap of the conventional saddle with the locking device assembly disposed therebetween, so that the retention ring maintains the locking device assembly between the free end of the conventional stirrup strap of the conventional saddle and the conventional stirrup strap of the conventional saddle.

STILL YET ANOTHER OBJECT of the present invention is to provide an extendable stirrup that further includes stirrup assembly mounting apparatus for pivotally mounting the stirrup assembly to the lower end of the rack assembly.

YET STILL ANOTHER OBJECT of the present invention is to provide an extendable stirrup wherein the stirrup assembly mounting apparatus includes a band that has a pair of interlocking free ends and a centrally-disposed throughbore that is disposed between the pair of interlocking free ends of the band of the stirrup assembly mounting apparatus.

STILL YET ANOTHER OBJECT of the present invention is to provide an extendable stirrup wherein the stirrup assembly mounting apparatus further includes a cylindrically-shaped support bar that has an upper portion and extends transversely outwardly from the lower end of the rack assembly and has a pair of ring keepers that are disposed in proximity to a pair of free ends of the cylindrically-shaped support bar of the rack assembly.

YET STILL ANOTHER OBJECT of the present invention is to provide an extendable stirrup wherein the rack assembly extends through the centrally-disposed throughbore of the band of the stirrup assembly mounting apparatus with .the band of the stirrup assembly mounting apparatus covering the upper portion of the cylindrically-shaped support bar of the rack assembly.

STILL YET ANOTHER OBJECT of the present invention is to provide an extendable stirrup wherein the band of the stirrup assembly mounting apparatus is wrapped around a crossbar of the stirrup assembly with the crossbar of the stirrup assembly in substantial abutment with the pair of ring keepers of the cylindrically-shaped support bar of the rack assembly.

YET STILL ANOTHER OBJECT of the present invention is to provide an extendable stirrup wherein the interlocking free ends of the band of the stirrup assembly mounting apparatus are interlocked, so that the crossbar of the stirrup assembly is maintained in substantial abutment with the pair of ring keepers of the cylindrically-shaped support bar of the rack assembly while the pair of ring keepers of the cylindrically-shaped support bar of the rack assembly reduce relative lateral movement between the band of the stirrup assembly mounting apparatus and the rack assembly.

STILL YET ANOTHER OBJECT of the present invention is to provide an extendable stirrup wherein the locking device assembly includes a hollow generally cylindrically-shaped pipe with a pair of externally-threaded and open ends and a centrally-disposed and laterally-oriented throughbore that passes laterally through the hollow generally cylindrically-shaped pipe of the locking device assembly midway between the pair of externally-threaded and open ends of the hollow generally cylindrically-shaped pipe of the locking device assembly.

YET STILL ANOTHER OBJECT of the present invention is to provide an extendable stirrup wherein the locking device assembly further includes a cylindrically-shaped retainer collar that extends normally outwardly from the centrally-disposed and laterally-oriented throughbore of the hollow generally cylindrically-shaped pipe of the locking device assembly.

STILL YET ANOTHER OBJECT of the present invention is to provide an extendable stirrup wherein the locking device assembly further includes a pair of internally-threaded retainer rings.

YET STILL ANOTHER OBJECT of the present invention is to provide an extendable stirrup wherein each of the pair of internally-threaded retainer rings of the locking device assembly has an outer perimeter and a threaded inner perimeter which threadably engages a respective end of the pair of externally-threaded and open ends of the hollow generally cylindrically-shaped pipe of the locking device assembly.

STILL YET ANOTHER OBJECT of the present invention is to provide an extendable stirrup wherein each of the pair of internally-threaded retainer rings of the locking device assembly has a radially-oriented and threaded throughbore that extends from the outer perimeter of each of the pair of internally-threaded retainer rings of the locking device assembly to the threaded inner perimeter of a respective ring of the pair of internally-threaded retainer rings of the locking device assembly.

YET STILL ANOTHER OBJECT of the present invention is to provide an extendable stirrup wherein the locking device assembly further includes a pair of allen screws.

STILL YET ANOTHER OBJECT of the present invention is to provide an extendable stirrup wherein each of the pair of allen screws of the locking device assembly threadably engages the radially-oriented and threaded throughbore of a respective ring of the pair of internally-threaded retainer rings of the locking device assembly, so that relative movement between said pair of internally-threaded retainer rings of said locking device assembly and said hollow generally cylindrically-shaped pipe of said locking device assembly is prevented by said pair of allen screws of said locking device assembly contacting said hollow generally cylindrically-shaped pipe of said locking device assembly.

YET STILL ANOTHER OBJECT of the present invention is to provide an extendable stirrup wherein the locking device assembly further includes a closed and internally-threaded end cap that replaceably threadably engages one end of the pair of externally-threaded and open ends of the hollow generally cylindrically-shaped pipe of the locking device assembly with one ring of the pair of internally-threaded retainer rings of the locking device assembly disposed between the closed and internally-threaded end cap of the locking device assembly and the cylindrically-shaped retainer collar of the locking device assembly, so that injury to a user from exposed threads of the one end of the pair of externally-threaded and open ends of the hollow generally cylindrically-shaped pipe of the locking device assembly is prevented and internal components of the locking device assembly can be easily serviced.

STILL YET ANOTHER OBJECT of the present invention is to provide an extendable stirrup wherein the locking device assembly further includes a substantially closed and internally-threaded end cap that has a center and replaceably threadably engages another end of the pair of externally-threaded and open ends of the hollow generally cylindrically-shaped pipe of the locking device assembly with another ring of the pair of internally-threaded retainer rings of the locking device assembly disposed between the substantially closed and internally-threaded end cap of the locking device assembly and the cylindrically-shaped retainer collar of the locking device assembly, so that injury to a user from exposed threads of the another end of the pair of externally-threaded and open ends of the hollow generally cylindrically-shaped pipe of the locking device assembly is prevented and internal components of the locking device assembly can be easily serviced.

YET STILL ANOTHER OBJECT of the present invention is to provide an extendable stirrup wherein the substantially closed and internally-threaded end cap of the locking device assembly has a centrally-disposed, axially-oriented, and circular-shaped throughbore that extends axially through the center of the substantially closed end cap of the locking device assembly.

STILL YET ANOTHER OBJECT of the present invention is to provide an extendable stirrup wherein the substantially closed and internally-threaded end cap of the locking device assembly further has a rectangular-shaped throughbore that extends radially outwardly from, and opens into, the centrally-disposed, axially-oriented, and circular-shaped throughbore of the substantially closed and internally-threaded end cap of the locking device assembly.

YET STILL ANOTHER OBJECT of the present invention is to provide an extendable stirrup wherein the locking device assembly further includes a stopper slide bar assembly that is movably contained in the hollow generally cylindrically-shaped pipe of the locking device assembly in proximity to the substantially closed and internally-threaded end cap of the locking device assembly.

STILL YET ANOTHER OBJECT of the present invention is to provide an extendable stirrup wherein the locking device assembly further includes a T-shaped pull handle that extends through the centrally-disposed, axially-oriented, and circular-shaped throughbore of the substantially closed and internally-threaded end cap of the locking device assembly and engages the stopper slide bar assembly of the locking device assembly.

YET STILL ANOTHER OBJECT of the present invention is to provide an extendable stirrup wherein the locking device assembly further includes a coil spring which is disposed in the hollow generally cylindrically-shaped pipe of the locking device assembly, around the T-shaped pull handle of the locking device assembly, and biases the stopper slide bar assembly of the locking device assembly away from the substantially closed and internally-threaded end cap of the locking device-assembly.

STILL YET ANOTHER OBJECT of the present invention is to provide an extendable stirrup wherein the stopper slide bar assembly of the locking device assembly includes a T-shaped main portion with a horizontal part that has an upper surface, a lower surface, a rear edge, a front edge, and a longitudinal axis.

YET STILL ANOTHER OBJECT of the present invention is to provide an extendable stirrup wherein the T-shaped main portion of the stopper slide bar assembly of the locking device assembly further has a vertical stem part that has a front edge and a rear edge and extends downwardly from the lower surface of, and along the longitudinal axis of, the horizontal part of the T-shaped main portion of the stopper slide bar assembly of the locking device assembly.

STILL YET ANOTHER OBJECT of the present invention is to provide an extendable stirrup wherein the rear edge of the vertical stem part of the T-shaped main portion of the stopper slide bar assembly of the locking device assembly is flush with the rear edge of the horizontal part of the T-shaped main portion of the stopper slide bar assembly of the locking device assembly.

YET STILL ANOTHER OBJECT of the present invention is to provide an extendable stirrup wherein the front edge of the vertical stem part of the T-shaped main portion of the stopper slide bar assembly of the locking device assembly terminates rearward of the front edge of the horizontal part of the T-shaped main portion of the stopper slide bar assembly of the locking device assembly so as to form a front edge pawl that forms the front edge of the horizontal part of the T-shaped main portion of the stopper slide bar assembly of the locking device assembly.

STILL YET ANOTHER OBJECT of the present invention is to provide an extendable stirrup wherein the stopper slide bar assembly of the locking device assembly further includes a substantially C-shaped pull handle part that has an upper horizontally-oriented element with a free end which is centered on the upper surface of the horizontal part of the T-shaped main portion of the stopper slide bar assembly of the locking device assembly and rearward of the front edge thereof.

YET STILL ANOTHER OBJECT of the present invention is to provide an extendable stirrup wherein the horizontally-oriented element of the substantially C-shaped pull handle part of the stopper slide bar assembly of the locking device assembly is slightly upwardly offset relative to the upper surface of the horizontal part of the T-shaped main portion of the stopper slide bar assembly of the locking device assembly and extends rearwardly past the rear edge of the horizontal part of the T-shaped main portion of the stopper slide bar assembly of the locking device assembly.

STILL YET ANOTHER OBJECT of the present invention is to provide an extendable stirrup wherein the substantially C-shaped pull handle part of the stopper slide bar assembly of the locking device assembly further has a vertically-oriented element that extends normally downwardly at one end from another end of the upper horizontally-oriented element of the substantially C-shaped pull handle part of the stopper slide bar assembly of the locking device assembly.

YET STILL ANOTHER OBJECT of the present invention is to provide an extendable stirrup wherein the vertically-oriented element of the substantially C-shaped pull handle part of the stopper slide bar assembly of the locking device assembly has a centrally-disposed throughbore that is in substantial alignment with the rear edge of the horizontal part of the T-shaped main portion of the stopper slide bar assembly of the locking device assembly.

STILL YET ANOTHER OBJECT of the present invention is to provide an extendable stirrup wherein the C-shaped pull handle part of the stopper slide bar assembly of the locking device assembly further has a lower horizontally-oriented element that extends at one end normally forwardly from another end of the vertically-oriented element of the substantially C-shaped pull handle part of the stopper slide bar assembly of the locking device assembly and terminates in a slotted free end that has an axially-oriented and centrally-disposed throughslot that receives the vertical stem part of the T-shaped main portion of the stopper slide bar assembly of the locking device assembly.

YET STILL ANOTHER OBJECT of the present invention is to provide an extendable stirrup wherein the T-shaped pull handle of the locking device assembly includes a shaft portion with an externally-threaded free distal end and a proximal end from which an arm portion extends normally outwardly therefrom.

STILL YET ANOTHER OBJECT of the present invention is to provide an extendable stirrup wherein the T-shaped pull handle of the locking device assembly further includes an internally-threaded stop that is threadably engaged to the externally-threaded free distal end of the shaft portion of the T-shaped pull handle of the locking device assembly and a rectangular-parallelepiped-shaped lock block that is disposed on the shaft portion of the T-shaped pull handle of the locking device assembly, in proximity to the arm portion of the T-shaped pull handle of the locking device assembly.

YET STILL ANOTHER OBJECT of the present invention is to provide an extendable stirrup wherein the externally-threaded free distal end of the shaft portion of the T-shaped pull handle of the locking device assembly passes movably through the centrally-disposed throughbore of the vertically-oriented element of the substantially C-shaped pull handle part of the stopper slide bar assembly of the locking device assembly with the internally threaded stop of the T-shaped pull handle of the locking device assembly threaded thereon and positioned between the vertically-oriented element of the substantially C-shaped pull handle part of the stopper slide bar assembly of the locking device assembly and the rear edge of the horizontal part of the T-shaped main portion of the stopper slide bar assembly of the locking device assembly and in alignment therewith.

STILL YET ANOTHER OBJECT of the present invention is to provide an extendable stirrup wherein the rectangular-parallelepiped-shaped lock block of the T-shaped pull handle of the locking device assembly is alignable and engagable with the rectangular-shaped throughbore of the substantially closed and internally-threaded end cap of the locking device assembly so as to be selectively engagable therein.

YET STILL ANOTHER OBJECT of the present invention is to provide an extendable stirrup wherein the rack assembly includes an elongated and cylindrically-shaped rack that has an outer surface, an upper end, a lower end, and a plurality of longitudinally-disposed, adjacently-positioned, collinear, and triangular-shaped teeth that extend outwardly from the outer surface of the elongated and cylindrically-shaped rack of the rack assembly from the upper end of the elongated and cylindrically-shaped rack of the rack assembly to the lower end of the elongated and cylindrically-shaped rack of the rack assembly.

STILL YET ANOTHER OBJECT of the present invention is to provide an extendable stirrup wherein each of the plurality of longitudinally-disposed, adjacently-positioned, collinear, and triangular-shaped teeth of the outer surface of the elongated and cylindrically-shaped rack of the rack assembly has a laterally-oriented and straight lower edge and a downwardly-and-outwardly slanting and straight side edge that extends from the outer surface of the elongated and cylindrically-shaped rack of the rack assembly to a free end of the laterally-oriented and straight lower edge of the plurality of longitudinally-disposed, adjacently-positioned, collinear, and triangular-shaped teeth of the outer surface of the elongated and cylindrically-shaped rack of the rack assembly.

YET STILL ANOTHER OBJECT of the present invention is to provide an extendable stirrup wherein the elongated and cylindrically-shaped rack of the rack assembly extends through the cylindrically-shaped retainer collar of the locking device assembly and the centrally-disposed and laterally-oriented throughbore of the hollow generally cylindrically-shaped pipe of the locking device assembly with the plurality of longitudinally-disposed, adjacently-positioned, collinear, and triangular-shaped teeth of the outer surface of the elongated and cylindrically-shaped rack of the rack assembly facing the stopper slide bar assembly of the locking device assembly.

STILL YET ANOTHER OBJECT of the present invention is to provide an extendable stirrup wherein the rack assembly further includes a stop plate that is disposed on the upper end of the elongated and cylindrically-shaped rack of the rack assembly and has a lower surface with a cylindrically-shaped retainer collar that extends downwardly from the lower surface of the stop plate of the rack assembly.

YET STILL ANOTHER OBJECT of the present invention is to provide an extendable stirrup wherein the rack assembly further includes a spring that surrounds the elongated and cylindrically-shaped rack of the rack assembly and has an upper end that sits in the cylindrically-shaped retainer collar of the lower surface of the stop plate of the rack assembly and a lower end that sits in the cylindrically-shaped retainer collar of the locking device assembly, so that the elongated and cylindrically-shaped rack of the rack assembly and the locking device assembly are biased relative to each other.

STILL YET ANOTHER OBJECT of the present invention is to provide an extendable stirrup wherein the rack assembly includes a slender, elongated, and rectangular-parallelepiped-shaped rack.

FINALLY, YET STILL ANOTHER OBJECT of the present invention is to provide method of using an extendable stirrup for assisting equestrians of different heights to mount a horse that includes the steps of loosening a pair of allen screws a pair of internally-threaded retainer rings of a locking device assembly of the extendable stirrup, threading the pair of internally-threaded retainer rings of the locking device assembly outwardly along a pair of externally-threaded and open ends of a hollow generally cylindrically-shaped pipe of the locking device assembly, putting a hole in a conventional stirrup strap of a conventional saddle, wrapping a free end of the conventional stirrup strap around the hollow generally cylindrically-shaped pipe of the locking device assembly with an elongated and cylindrically-shaped rack of a rack assembly of the extendable stirrup extending downwardly through the hole of the conventional stirrup strap, attaching a retention ring of the extendable stirrup to maintain the free end of the conventional stirrup strap against the conventional stirrup strap while maintaining the locking device assembly therebetween, threading the pair of internally-threaded retainer rings of the locking device assembly inwardly along the pair of externally-threaded and open ends of the hollow generally cylindrically-shaped pipe of the locking device assembly until the pair of internally-threaded retainer rings of the locking device assembly generally abut against the conventional stirrup strap, tightening the pair of allen screws of the pair of internally-threaded retainer rings of the locking device assembly, so that the pair of internally-threaded retainer rings of the locking device assembly are prevented from further threading and the conventional stirrup strap is prevented against lateral movement, passing the lower end of the elongated and cylindrically-shaped rack of a rack assembly through a centrally-disposed throughbore of a band of the extendable stirrup, wrapping the band around a crossbar of a stirrup assembly of the extendable stirrup with the crossbar of the stirrup assembly in substantial abutment with a pair of ring keepers of a cylindrically-shaped support bar of the rack assembly, interlocking a pair of interlocking free ends of the band, so that the crossbar of the stirrup assembly is maintained in substantial abutment with the pair of ring keepers of the cylindrically-shaped support bar of the rack assembly while the pair of ring keepers of the cylindrically-shaped support bar of the rack assembly reduce relative lateral movement between the band and the rack assembly, pulling outwardly a T-shaped pull handle of the locking device assembly against biasing of a coil spring of the locking device assembly, causing a rectangular-parallelepiped-shaped lock block of the T-shaped pull handle of the locking device assembly to leave a rectangular-shaped throughbore of a substantially closed and internally-threaded end cap of the locking device assembly, causing a front edge pawl of a front edge of a horizontal part of a T-shaped main portion of a stopper slide bar assembly of the locking device assembly to disengage with a respective tooth of a plurality of longitudinally-disposed, adjacently-positioned, collinear, and triangular-shaped teeth of an outer surface of the elongated and cylindrically-shaped rack of the rack assembly, rotating the T-shaped pull handle of the locking device assembly until the rectangular-parallelepiped-shaped lock block of the T-shaped pull handle of the locking device assembly clears the rectangular-shaped throughbore of the substantially closed and internally-threaded end cap of the locking device assembly and rests on the substantially closed and internally-threaded end cap of the locking device assembly, so that the elongated and cylindrically-shaped rack of the rack assembly is free to move relative to the locking device assembly, moving the stirrup assembly relative to the locking device assembly, against biasing of a spring of the rack assembly, until desired height of the stirrup assembly is achieved, so that equestrians of different heights are assisted in mounting the horse, rotating the T-shaped pull handle of the locking device assembly until the rectangular-parallelepiped-shaped lock block of the T-shaped pull handle of the locking device assembly enters the rectangular-shaped throughbore of the substantially closed and internally-threaded end cap of the locking device assembly, releasing the T-shaped pull handle of the locking device assembly, and engaging, by biasing of the spring of the locking device assembly, the front edge pawl of the front edge of the horizontal part of the T-shaped main portion of the stopper slide bar assembly of the locking device assembly with a respective tooth of the plurality of longitudinally-disposed, adjacently-positioned, collinear, and triangular-shaped teeth of the outer surface of the elongated and cylindrically-shaped rack of the rack assembly, so that relative movement between the stirrup assembly and the locking device assembly is prevented and the equestrian can use the stirrup assembly to mount the horse.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 2:
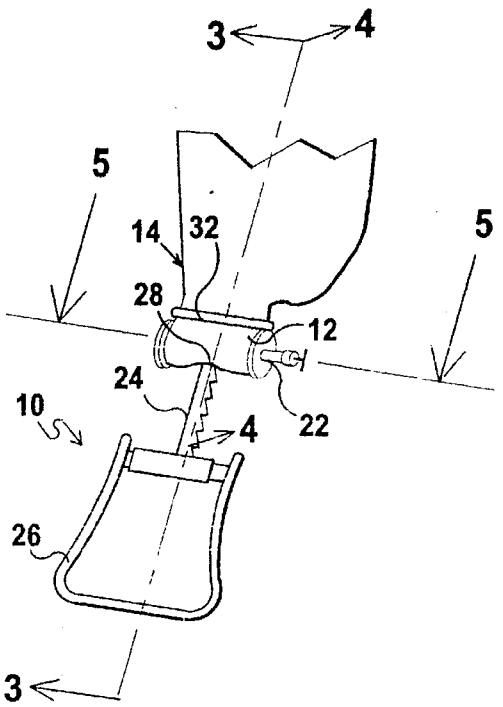
FIG. 2 is an enlarged diagrammatic perspective view of the present invention attached to the stirrup leather of a conventional saddle.

| | |
|---|---|
| 10 | extendable stirrup of the present invention |
| 12 | conventional saddle stirrup leather strap |
| 14 | conventional saddle |
| 16 | equestrian foot |
| 18 | equestrian |
| 20 | horse |

-continued 22 locking device assembly
24 rack assembly
26 stirrup assembly
28 saddle stirrup strap hole
30 conventional saddle stirrup leather strap free end
32 retention ring
34 2" wide tough steel band
36 pair of band interlocking free ends
38 19/32" band centrally-disposed throughbore
40 3/16" dia. rack assembly cylindrically-shaped support bar
44 pair of 5/8" O.D. rack assembly support bar ring keepers
46 pair of free ends
48 stirrup assembly crossbar
50 1" locking device assembly hollow generally cylindrically-shaped pipe
52 pair of locking device assembly pipe externally-threaded and open ends
54 locking device assembly pipe centrally-disposed and laterally-oriented throughbore
56 locking device assembly cylindrically-shaped retainer collar
58 pair of locking device assembly internally-threaded retainer rings
60 locking device assembly retainer ring radially-oriented and threaded throughbore
62 locking device assembly retainer ring outer perimeter
64 inner perimeter locking device assembly retainer ring threaded inner perimeter
66 pair of locking device assembly retainer ring allen screws
68 allen key
70 locking device assembly closed and internally-threaded end cap
72 locking device assembly substantially closed and internally-threaded end cap
74 locking device assembly substantially closed end cap centrally-disposed, axially-oriented, and circular-shaped throughbore
76 locking device assembly substantially closed end cap rectangular-shaped throughbore
78 locking device assembly stopper slide bar assembly
80 locking device assembly T-shaped pull handle
82 locking device assembly straight coil spring
84 locking device assembly stopper slide bar assembly T-shaped main portion
85 locking device assembly stopper slide bar assembly main portion horizontal part front edge pawl
86 locking device assembly stopper slide bar assembly main portion horizontal part
87 locking device assembly stopper slide bar assembly substantially C-shaped pull handle part
88 locking device assembly stopper slide bar assembly main portion vertical stem part
89 locking device assembly stopper slide bar assembly pull handle part upper horizontally-oriented element
90 locking device assembly stopper slide bar assembly pull handle part upper horizontally-oriented element free end
92 locking device assembly stopper slide bar assembly pull handle part vertically-oriented element
94 locking device assembly stopper slide bar assembly pull handle part vertically-oriented element centrally-disposed throughbore
96 locking device assembly stopper slide bar assembly pull handle part lower horizontally-oriented element
98 locking device assembly stopper slide bar assembly pull handle part lower horizontally-oriented element slotted free end
100 locking device assembly stopper slide bar assembly pull handle part lower horizontally-oriented element slotted free end axially-oriented and centrally-disposed throughslot
102 locking device assembly pull handle shaft portion
104 locking device assembly pull handle shaft portion externally-threaded free distal end
105 locking device assembly pull handle shaft portion proximal end
106 locking device assembly pull handle arm portion
108 locking device assembly pull handle internally threaded stop
110 locking device assembly pull handle rectangular-parallelepiped-shaped lock block
112 rack assembly rack
114 rack assembly rack upper end
116 rack assembly rack lower end
118 plurality of rack assembly rack longitudinally-disposed, adjacently-positioned, collinear, and triangular-shaped teeth
120 rack assembly rack tooth laterally-oriented and straight lower edge
122 rack assembly rack tooth downwardly-and-outwardly slanting and straight side edge
124 rack assembly spring stop plate -continued 126 rack assembly spring stop plate lower surface cylindrically-shaped retainer collar
128 rack assembly special spring
130 rack assembly spring upper end
132 rack assembly spring lower end
134 locking device assembly T-shaped pull handle rotation release arrow
136 locking device assembly T-shaped pull handle releasing rotation lock arrow

DETAILED DESCRIPTION OF THE PREFERRED EMBODIMENT

Figure 1:
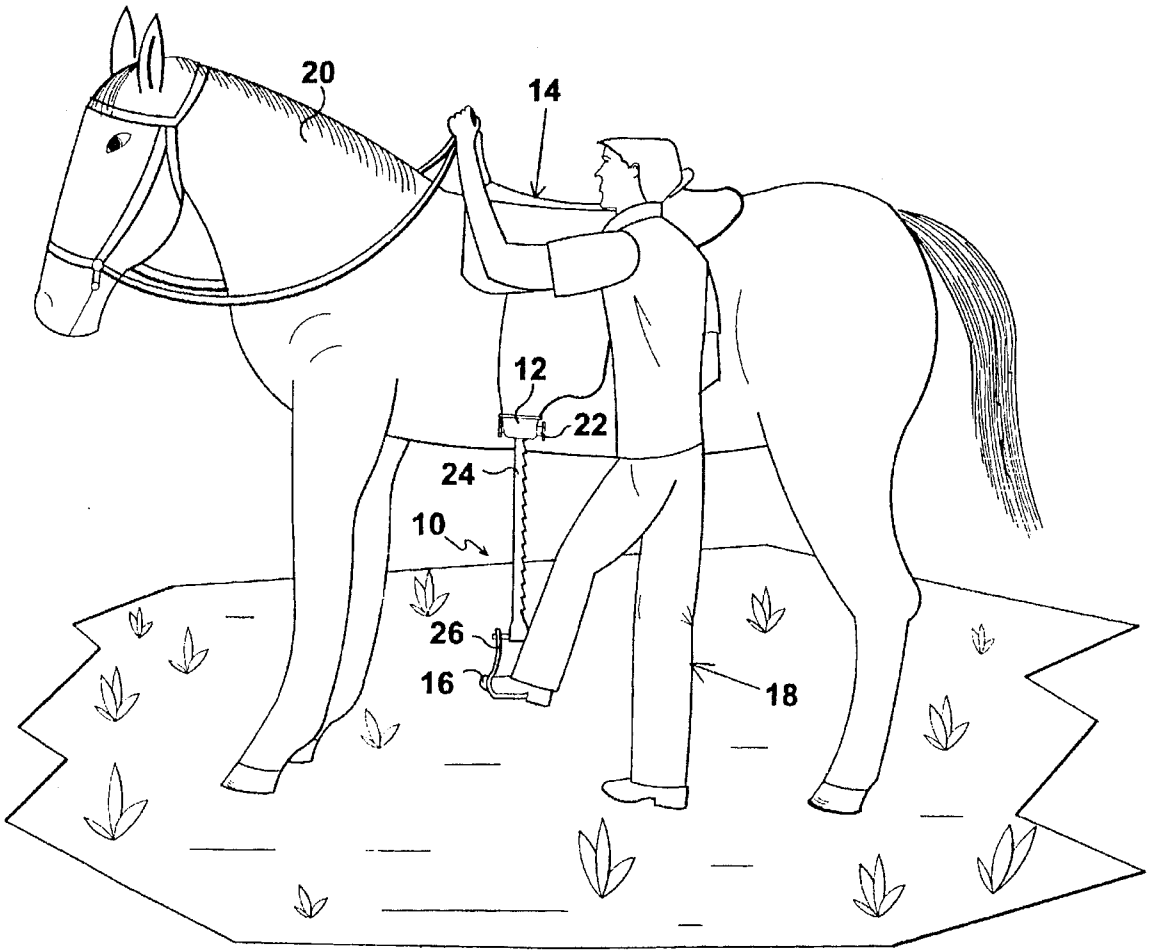
FIG. 1 is a diagrammatic perspective view illustrating an equestrian utilizing the present invention to mount a horse.

Referring now to the figures in which like numerals indicate like parts, and particularly to FIG. 1, the extendable stirrup of the present invention is shown generally at 10 attached to a conventional saddle stirrup leather strap 12 of a conventional saddle 14 and being received by an equestrian foot 16 of an equestrian 18 who is mounting a horse 20.

The extendable stirrup 10 includes a locking device assembly 22 that is attachable to the conventional saddle stirrup leather strap 12 of the conventional saddle 14, a rack assembly 24 that is extendable from, and retractable into, the locking device assembly 22, and a stirrup assembly 26 that is pivotally mounted to the rack assembly 24.

The manner in which the extendable stirrup 10 is attached to the conventional saddle stirrup leather strap 12 of the conventional saddle 14 can best be seen in FIGS. 2 and 3, and as such, will be discussed with reference thereto.

A saddle stirrup strap hole 28 is put in the conventional saddle stirrup leather strap 12 of the conventional saddle 14 by the equestrian 18, by the customer, or by any other person.

The conventional saddle stirrup leather strap 12 of the conventional saddle 14 has a conventional saddle stirrup leather strap free end 30 that is wrapped around the locking device assembly 22 with the rack assembly 24 extending downwardly through the saddle stirrup strap hole 28 of the conventional saddle stirrup leather strap 12 of the conventional saddle 14.

The conventional saddle stirrup leather strap free end 30 of the conventional saddle stirrup leather strap 12 of the conventional saddle 14 is maintained against the conventional saddle stirrup leather strap 12 of the conventional saddle 14, with the locking device assembly 22 therebetween by a retention ring 32 whose inner width is substantially equal to twice the thickness of the conventional saddle stirrup leather strap 12 of the conventional saddle 14, so that the retention ring 32 maintains the locking device assembly 22 between the conventional saddle stirrup leather strap free end 30 of the conventional saddle stirrup leather strap 12 of the conventional saddle 14 and the conventional saddle stirrup leather strap 12 of the conventional saddle 14.

The manner in which the rack assembly 24 is attached to the stirrup assembly 26 can best be seen in FIG. 3A, and as such, will be discussed with reference thereto.

The stirrup assembly 26 is attached to the rack assembly 24 by a 2" wide tough steel band 34 that has a pair of band interlocking free ends 36 and a 19/32" band centrally-disposed throughbore 38 that is disposed between the pair of band interlocking free ends 36 of the 2" wide tough steel band 34.

A 3/16" dia. rack assembly cylindrically-shaped support bar 40 of the rack assembly 24 extends transversely from each side of the lower end of the rack assembly 24 and has a pair of 5/8" O.D. rack assembly support bar ring keepers 44 that are disposed in proximity to a pair of free ends 46 of the 3/16" dia. rack assembly cylindrically-shaped support bar 40 of the rack assembly 24.

The rack assembly 24 is passed through the 9/32" band centrally-disposed throughbore 38 of the 2" wide tough steel band 34 with the 2" wide tough steel band 34 covering the upper portion of the 3/16" dia. rack assembly cylindrically-shaped support bar 40 of the rack assembly 24.

The 2" wide tough steel band 34 is then wrapped around a stirrup assembly crossbar 48 of the stirrup assembly 26 with the stirrup assembly crossbar 48 of the stirrup assembly 26 in substantial abutment with the pair of 5/8" O.D. rack assembly support bar ring keepers 44 of the 3/16" dia. rack assembly cylindrically-shaped support bar 40 of the rack assembly 24.

The band interlocking free ends 36 of the 2" wide tough steel band 34 are interlocked, so that the stirrup assembly crossbar 48 of the stirrup assembly 26 is maintained in substantial abutment with the pair of 5/8" O.D. rack assembly support bar ring keepers 44 of the 3/16" dia. rack assembly cylindrically-shaped support bar 40 of the rack assembly 24 while the pair of 5/8" O.D. rack assembly support bar ring keepers 44 of the rack assembly 24 reduce the relative lateral movement between the 2" wide tough steel band 34 and the rack assembly 24.

The configuration of the locking device assembly 22 can best be seen in FIGS. 4 and 5, and as such, will be discussed with reference thereto.

The locking device assembly 22 includes a 1" locking device assembly hollow generally cylindrically-shaped pipe 50 with a pair of locking device assembly pipe externally-threaded and open ends 52 and a locking device assembly pipe centrally-disposed and laterally-oriented throughbore 54 that passes laterally through the 1" locking device assembly hollow generally cylindrically-shaped pipe 50 of the locking device assembly 22 at substantially the midpoint between the pair of locking device assembly pipe externally-threaded and open ends 52 of the 1" locking device assembly hollow generally cylindrically-shaped pipe 50 of the locking device assembly 22.

The locking device assembly 22 further includes a locking device assembly cylindrically-shaped retainer collar 56 that extends normally outwardly from the locking device assembly pipe centrally-disposed and laterally-oriented throughbore 54 of the 1" locking device assembly hollow generally cylindrically-shaped pipe 50 of the locking device assembly 22.

The locking device assembly 22 further includes a pair of locking device assembly internally-threaded retainer rings 58. Each of the pair of locking device assembly internally-threaded retainer rings 58 of the locking device assembly 22 threadably engages a respective end of the pair of locking device assembly pipe externally-threaded and open ends 52 of the 1" locking device assembly hollow generally cylindrically-shaped pipe 50 of the locking device assembly 22.

Each of the pair of locking device assembly internally-threaded retainer rings 58 of the locking device assembly 22 has 2.5" dia., 3/16" rounded edges for safety and a locking device assembly retainer ring radially-oriented and threaded throughbore 60 that extends from a locking device assembly retainer ring outer perimeter 62 of each of the pair of locking device assembly internally-threaded retainer rings 58 of the locking device assembly 22 to a locking device assembly retainer ring threaded inner perimeter 64 of a respective ring of the pair of locking device assembly internally-threaded retainer rings 58 of the locking device assembly 22.

The locking device assembly 22 further includes a pair of locking device assembly retainer ring allen screws 66. Each of the pair of locking device assembly retainer ring allen screws 66 of the locking device assembly 22 threadably engages the locking device assembly retainer ring radially-oriented and threaded throughbore 60 of a respective ring of the pair of locking device assembly internally-threaded retainer rings 58 of the locking device assembly 22 and are threaded therein by an allen key 68, so that relative movement between said pair of locking device assembly internally-threaded retainer rings 50 of said locking device assembly 22 and said 1" locking device assembly hollow generally cylindrically-shaped pipe 50 of said locking device assembly 22 is prevented by said pair locking device assembly retainer ring of allen screws 66 of said locking device assembly 22 contacting said 1" locking device assembly hollow generally cylindrically-shaped pipe 50 of said locking device assembly 22.

The locking device assembly 22 further includes a locking device assembly closed and internally-threaded end cap 70 that replaceably threadably engages one end of the pair of locking device assembly pipe externally-threaded and open ends 52 of the 1" locking device assembly hollow generally cylindrically-shaped pipe 50 of the locking device assembly 22 with a respective ring of the pair of locking device assembly internally-threaded retainer rings 58 of the locking device assembly 22 disposed between the locking device assembly closed and internally-threaded end cap 70 of the locking device assembly 22 and the locking device assembly cylindrically-shaped retainer collar 56 of the locking device assembly 22, so that injury to a user from the threads of the one end of the pair of locking device assembly pipe externally-threaded and open ends 52 of the 1" locking device assembly hollow generally cylindrically-shaped pipe 50 of the locking device assembly 22 is prevented and the internal components of the locking device assembly 22 can be easily serviced.

The locking device assembly 22 further includes a locking device assembly substantially closed and internally-threaded end cap 72 that replaceably threadably engages the other end of the pair of locking device assembly pipe externally-threaded and open ends 52 of the 1" locking device assembly hollow generally cylindrically-shaped pipe 50 of the locking device assembly 22 with a respective ring of the pair of locking device assembly internally-threaded retainer rings 58 of the locking device assembly 22 disposed between the locking device assembly substantially closed and internally-threaded end cap 72 of the locking device assembly 22 and the locking device assembly cylindrically-shaped retainer collar 56 of the locking device assembly 22, so that injury to a user from the threads of the other end of the pair of locking device assembly pipe externally-threaded and open ends 52 of the 1" locking device assembly hollow generally cylindrically-shaped pipe 50 of the locking device assembly 22 is prevented and the internal components of the locking device assembly 22 can be easily serviced.

Figure 10:
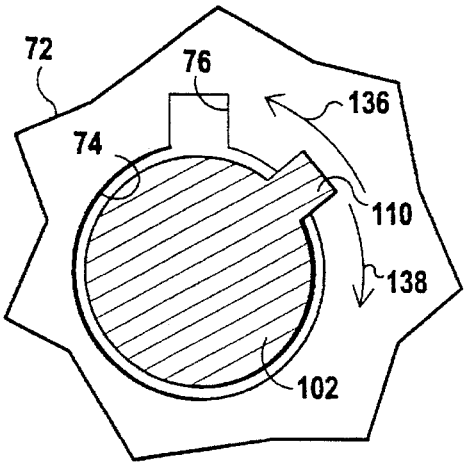
FIG. 10 is a cross sectional view taken on line 10—10 in FIG. 9.

As shown in FIG. 10, the locking device assembly substantially closed and internally-threaded end cap 72 of the locking device assembly 22 has a locking device assembly substantially closed end cap centrally-disposed, axially-oriented, and circular-shaped throughbore 74 that passes axially through the center of the locking device assembly substantially closed end cap 72 of the locking device assembly 22.

Extending radially outwardly from, and opening into, the locking device assembly substantially closed end cap centrally-disposed, axially-oriented, and circular-shaped throughbore 74 of the locking device assembly substantially closed and internally-threaded end cap 72 of the locking device assembly 22 is a locking device assembly substantially closed end cap rectangular-shaped throughbore 76.

The locking device assembly 22 further includes a locking device assembly stopper slide bar assembly 78 which is movably disposed in the 1" locking device assembly hollow generally cylindrically-shaped pipe 50 of the locking device assembly 22 in proximity to the locking device assembly substantially closed and internally-threaded end cap 72 of the locking device assembly 22.

The locking device assembly 22 further includes a locking device assembly T-shaped pull handle 80 that extends through the locking device assembly substantially closed end cap centrally-disposed, axially-oriented, and circular-shaped throughbore 74 of the locking device assembly substantially closed and internally-threaded end cap 72 of the locking device assembly 22 and engages the locking device assembly stopper slide bar assembly 78 of the locking device assembly 22.

The locking device assembly 22 further includes a locking device assembly straight coil spring 82 which is disposed in the 1" locking device assembly hollow generally cylindrically-shaped pipe 50 of the locking device assembly 22, around the locking device assembly T-shaped pull handle 80 of the locking device assembly 22, and biases the locking device assembly stopper slide bar assembly 78 of the locking device assembly 22 away from the locking device assembly substantially closed and internally-threaded end cap 72 of the locking device assembly 22. The locking device assembly straight coil spring 82 of the locking device assembly 22 has approximately 1" of travel.

The configuration of the locking device assembly stopper slide bar assembly 78 of the locking device assembly 22 can best be seen in FIGS. 4, and 6–8, and as such, will be discussed with reference thereto.

The locking device assembly stopper slide bar assembly 78 of the locking device assembly 22 includes a locking device assembly stopper slide bar assembly T-shaped main portion 84 that is ⅝" high.

The locking device assembly stopper slide bar assembly T-shaped main portion 84 of the locking device assembly stopper slide bar assembly 78 of the locking device assembly 22 has a locking device assembly stopper slide bar assembly main portion horizontal part 86 that is 1" sq. and has an upper surface and a lower surface.

The locking device assembly stopper slide bar assembly T-shaped main portion 84 of the locking device assembly stopper slide bar assembly 78 of the locking device assembly 22 further has a locking device assembly stopper slide bar assembly main portion vertical stem part 88 that extends downwardly from the lower surface of, and along the longitudinal axis of, the locking device assembly stopper slide bar assembly main portion horizontal part 86 of the locking device assembly stopper slide bar assembly T-shaped main portion 84 of the locking device assembly stopper slide bar assembly 78 of the locking device assembly 22.

The locking device assembly stopper slide bar assembly main portion vertical stem part 88 of the locking device assembly stopper slide bar assembly T-shaped main portion 84 of the locking device assembly stopper slide bar assembly 78 of the locking device assembly 22 is ¾" long and 3/16" thick and whose rear edge is flush with the rear edge of the locking device assembly stopper slide bar assembly main portion horizontal part 86 of the locking device assembly stopper slide bar assembly T-shaped main portion 84 of the locking device assembly stopper slide bar assembly 78 of the locking device assembly 22.

The front edge of the locking device assembly stopper slide bar assembly main portion vertical stem part 88 of the locking device assembly stopper slide bar assembly T-shaped main portion 84 of the locking device assembly stopper slide bar assembly 78 of the locking device assembly 22 terminates ¼" rearward from the front edge of the locking device assembly stopper slide bar assembly main portion horizontal part 86 of the locking device assembly stopper slide bar assembly T-shaped main portion 84 of the locking device assembly stopper slide bar assembly 78 of the locking device assembly 22 so as to form a locking device assembly stopper slide bar assembly main portion horizontal part front edge pawl 85 that forms the front edge of the locking device assembly stopper slide bar assembly main portion horizontal part 86 of the locking device assembly stopper slide bar assembly T-shaped main portion 84 of the locking device assembly stopper slide bar assembly 78 of the locking device assembly 22.

The locking device assembly stopper slide bar assembly 78 of the locking device assembly 22 further includes a locking device assembly stopper slide bar assembly substantially C-shaped pull handle part 87 that is shaped from ¾"×⅛" soft steel.

The locking device assembly stopper slide bar assembly substantially C-shaped pull handle part 87 of the locking device assembly stopper slide bar assembly 78 of the locking device assembly 22 has a locking device assembly stopper slide bar assembly pull handle part upper horizontally-oriented element 89 with a locking device assembly stopper slide bar assembly pull handle part upper horizontally-oriented element free end 90.

The locking device assembly stopper slide bar assembly pull handle part upper horizontally-oriented element free end 90 of the locking device assembly stopper slide bar assembly pull handle part upper horizontally-oriented element 89 of the locking device assembly stopper slide bar assembly substantially C-shaped pull handle part 87 of the locking device assembly stopper slide bar assembly 78 of the locking device assembly 22 is welded to the upper surface of the locking device assembly stopper slide bar assembly main portion horizontal part 86 of the locking device assembly stopper slide bar assembly T-shaped main portion 84 of the locking device assembly stopper slide bar assembly 78 of the locking device assembly 22, centered on the longitudinal axis thereof and at a position 9/16" rearward from the front edge thereof.

The locking device assembly stopper slide bar assembly pull handle part upper horizontally-oriented element 89 of the locking device assembly stopper slide bar assembly substantially C-shaped pull handle part 87 of the locking device assembly stopper slide bar assembly 78 of the locking device assembly 22 is slightly upwardly offset relative to the upper surface of the locking device assembly stopper slide bar assembly main portion horizontal part 86 of the locking device assembly stopper slide bar assembly T-shaped main portion 84 of the locking device assembly stopper slide bar assembly 78 of the locking device assembly 22 and extends rearwardly 5/16" past the rear edge of the locking device assembly stopper slide bar assembly main portion horizontal part 86 of the locking device assembly stopper slide bar assembly T-shaped main portion 84 of the locking device assembly stopper slide bar assembly 78 of the locking device assembly 22 for a total length of ⅞".

The locking device assembly stopper slide bar assembly substantially C-shaped pull handle part 87 of the locking device assembly stopper slide bar assembly 78 of the locking device assembly 22 further has a locking device assembly stopper slide bar assembly pull handle part vertically-oriented element 92 that extends downwardly at one end from the other end of the locking device assembly stopper slide bar assembly pull handle part upper horizontally-oriented element 89 of the locking device assembly stopper slide bar assembly substantially C-shaped pull handle part 87 of the locking device assembly stopper slide bar assembly 78 of the locking device assembly 22.

The locking device assembly stopper slide bar assembly pull handle part vertically-oriented element 92 of the locking device assembly stopper slide bar assembly substantially C-shaped pull handle part 87 of the locking device assembly stopper slide bar assembly 78 of the locking device assembly 22 has a locking device assembly stopper slide bar assembly pull handle part vertically-oriented element centrally-disposed throughbore 94 that is in substantial alignment with the rear edge of the locking device assembly stopper slide bar assembly main portion horizontal part 86 of the locking device assembly stopper slide bar assembly T-shaped main portion 84 of the locking device assembly stopper slide bar assembly 78 of the locking device assembly.

The locking device assembly stopper slide bar assembly substantially C-shaped pull handle part 87 of the locking device assembly stopper slide bar assembly 78 of the locking device assembly 22 further has a locking device assembly stopper slide bar assembly pull handle part lower horizontally-oriented element 96 that extends at one end forwardly from the other end of the locking device assembly stopper slide bar assembly pull handle part vertically-oriented element 92 of the locking device assembly stopper slide bar assembly substantially C-shaped pull handle part 87 of the locking device assembly stopper slide bar assembly 78 of the locking device assembly 22 and terminates in a locking device assembly stopper slide bar assembly pull handle part lower horizontally-oriented element slotted free end 98.

The locking device assembly stopper slide bar assembly pull handle part lower horizontally-oriented element slotted free end 98 of the locking device assembly stopper slide bar assembly pull handle part lower horizontally-oriented element 96 of the locking device assembly stopper slide bar assembly substantially C-shaped pull handle part 87 of the locking device assembly stopper slide bar assembly 78 of the locking device assembly 22 has a locking device assembly stopper slide bar assembly pull handle part lower horizontally-oriented element slotted free end axially-oriented and centrally-disposed throughslot 100.

The locking device assembly stopper slide bar assembly pull handle part lower horizontally-oriented element slotted free end axially-oriented and centrally-disposed throughslot 100 of the locking device assembly stopper slide bar assembly pull handle part lower horizontally-oriented element slotted free end 98 of the locking device assembly stopper slide bar assembly pull handle part lower horizontally-oriented element 96 of the locking device assembly stopper slide bar assembly substantially C-shaped pull handle part 87 of the locking device assembly stopper slide bar assembly 78 of the locking device assembly 22 receives the locking device assembly stopper slide bar assembly main portion vertical stem part 88 of the locking device assembly stopper slide bar assembly T-shaped main portion 84 of the locking device assembly stopper slide bar assembly 78 of the locking device assembly 22 and is welded thereto 3/16" from the bottom edge thereof.

Figure 8:
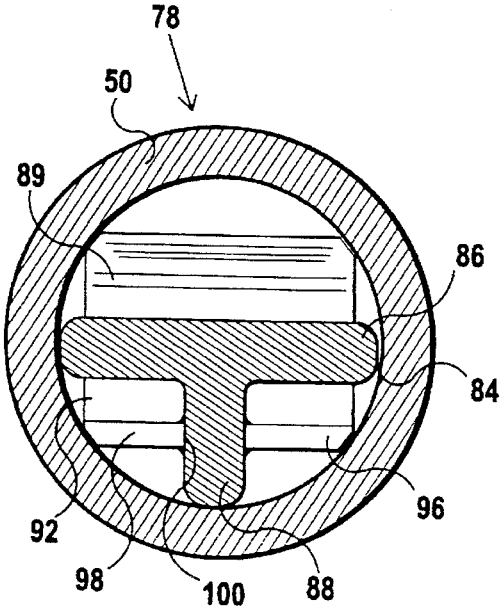
FIG. 8 is a diagrammatic front elevational view taken in the direction of arrow 8 in FIG. 6.

As shown in FIG. 8, the lower edge of the locking device assembly stopper slide bar assembly main portion vertical stem part 88 of the locking device assembly stopper slide bar assembly T-shaped main portion 84 of the locking device assembly stopper slide bar assembly 78 of the locking device assembly 22 and the outer edges of the locking device assembly stopper slide bar assembly main portion horizontal part 86 of the locking device assembly stopper slide bar assembly T-shaped main portion 84 of the locking device assembly stopper slide bar assembly 78 of the locking device assembly 22 are beveled, so that the locking device assembly stopper slide bar assembly 78 of the locking device assembly 22 can readily slide in the 1" locking device assembly hollow generally cylindrically-shaped pipe 50 of the locking device assembly 22.

Figure 9:
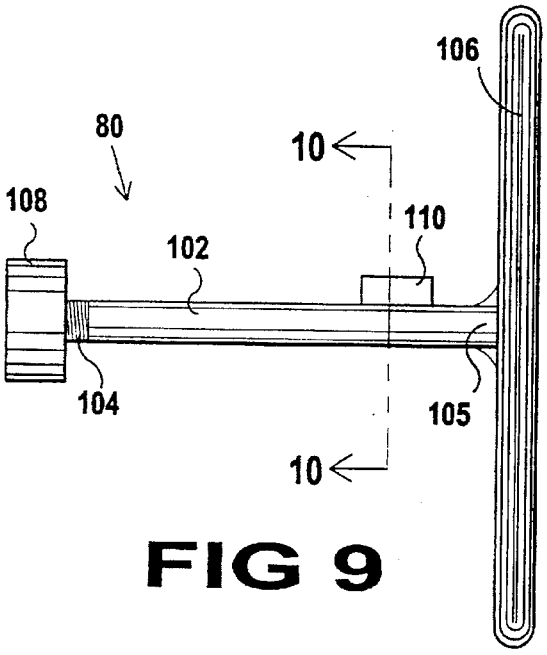
FIG. 9 is a side elevational view of the pull handle assembly.

The configuration of the locking device assembly T-shaped pull handle 80 of the locking device assembly 22 can best be seen in FIGS. 4 and 9, and as such, will be discussed with reference thereto.

The locking device assembly T-shaped pull handle 80 of the locking device assembly 22 includes a locking device assembly pull handle shaft portion 102 that is 1¾" long and ⅛" in diameter.

The locking device assembly pull handle shaft portion 102 of the locking device assembly T-shaped pull handle 80 of the locking device assembly 22 has a locking device assembly pull handle shaft portion externally-threaded free distal end 104 and a locking device assembly pull handle shaft portion proximal end 105 from which a locking device assembly pull handle arm portion 106, that is 2" long and ⅛" in diameter, is welded to, and extends normally outwardly at its center from the locking device assembly pull handle shaft portion proximal end 105 of the locking device assembly pull handle shaft portion 102 of the locking device assembly T-shaped pull handle 80 of the locking device assembly 22.

The free ends of the locking device assembly pull handle arm portion 106 of the locking device assembly T-shaped pull handle 80 of the locking device assembly 22 are beveled, so that the user is not hurt when it is grabbed.

The locking device assembly T-shaped pull handle 80 of the locking device assembly 22 further includes a locking device assembly pull handle internally threaded stop 108 that is drilled and tapped to be threadably engagable with the locking device assembly pull handle shaft portion externally-threaded free distal end 104 of the locking device assembly pull handle shaft portion 102 of the locking device assembly T-shaped pull handle 80 of the locking device assembly 22 and is 7/16" in diameter and 3/16" wide.

The locking device assembly pull handle internally threaded stop 108 of the locking device assembly T-shaped pull handle 80 of the locking device assembly 22 can be made from a standard nut that is sliced and shaped to suit.

The locking device assembly T-shaped pull handle 80 of the locking device assembly 22 further includes a locking device assembly pull handle rectangular-parallelepiped-shaped lock block 110 that is disposed on the locking device assembly pull handle shaft portion 102 of the locking device assembly T-shaped pull handle 80 of the locking device assembly 22, in proximity to the locking device assembly pull handle arm portion 106 of the locking device assembly T-shaped pull handle 80 of the locking device assembly 22.

Figure 4:
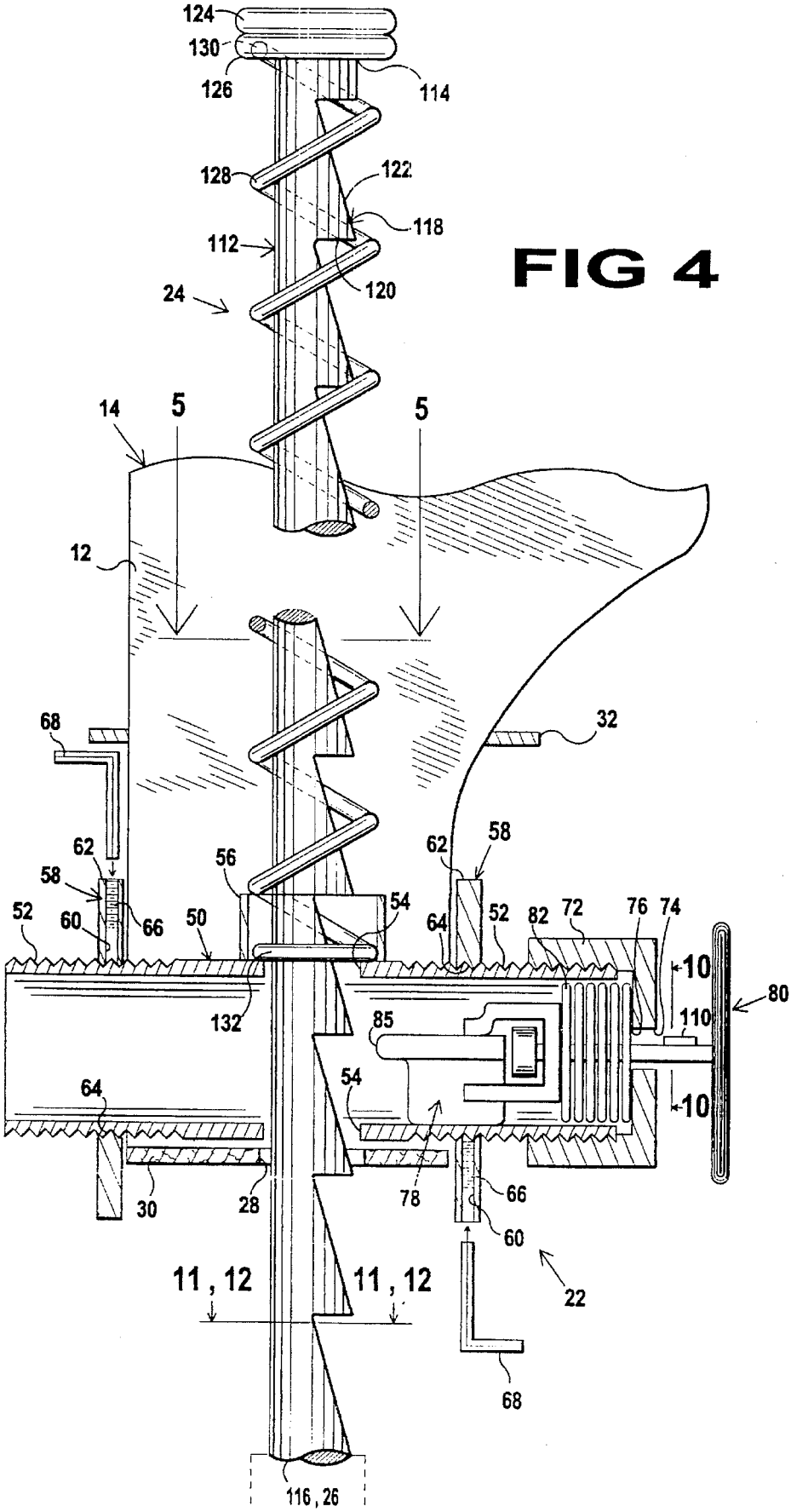
FIG. 4 is an enlarged diagrammatic front elevational view of the present invention with parts broken away and in partial cross section.
Figure 6:
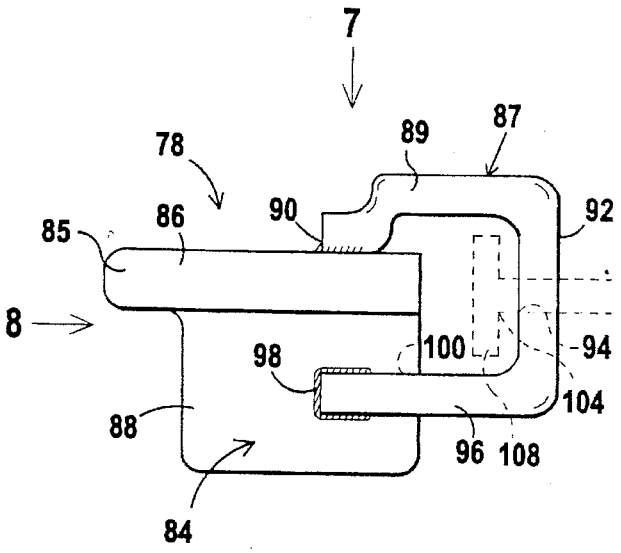
FIG. 6 is a diagrammatic side elevational view of the stopper slide bar assembly.
Figure 7:
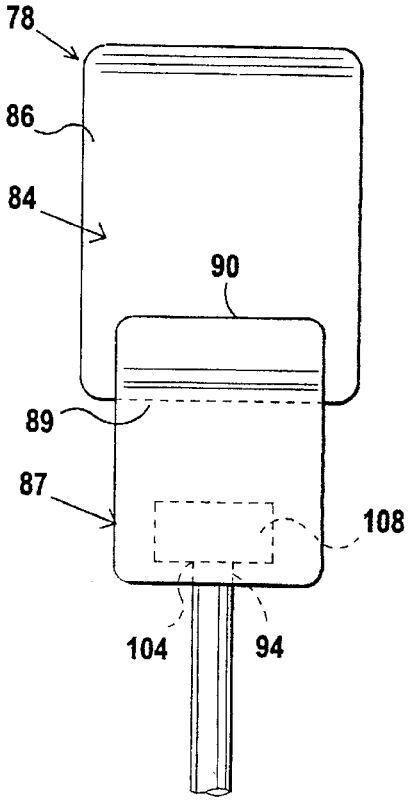
FIG. 7 is a diagrammatic top plan view taken in the direction of arrow 7 in FIG. 6.

As shown in FIGS. 4, 6 and 7, the locking device assembly pull handle shaft portion externally-threaded free distal end 104 of the locking device assembly pull handle shaft portion 102 of the locking device assembly T-shaped pull handle 80 of the locking device assembly 22 passes movably through the locking device assembly stopper slide bar assembly pull handle part vertically-oriented element centrally-disposed throughbore 94 of the locking device assembly stopper slide bar assembly pull handle part vertically-oriented element 92 of the locking device assembly stopper slide bar assembly 78 of the locking device assembly 22 with the locking device assembly pull handle internally threaded stop 108 of the locking device assembly T-shaped pull handle 80 of the locking device assembly 22 threaded thereon and positioned between the locking device assembly stopper slide bar assembly pull handle part vertically-oriented element 92 of the locking device assembly stopper slide bar assembly substantially C-shaped pull handle part 87 of the locking device assembly stopper slide bar assembly 78 of the locking device assembly 22 and the rear edge of the locking device assembly stopper slide bar assembly main portion horizontal part 86 of the locking device assembly stopper slide bar assembly T-shaped main portion 84 of the locking device assembly stopper slide bar assembly 78 of the locking device assembly 22 and in alignment therewith.

Figure 5:
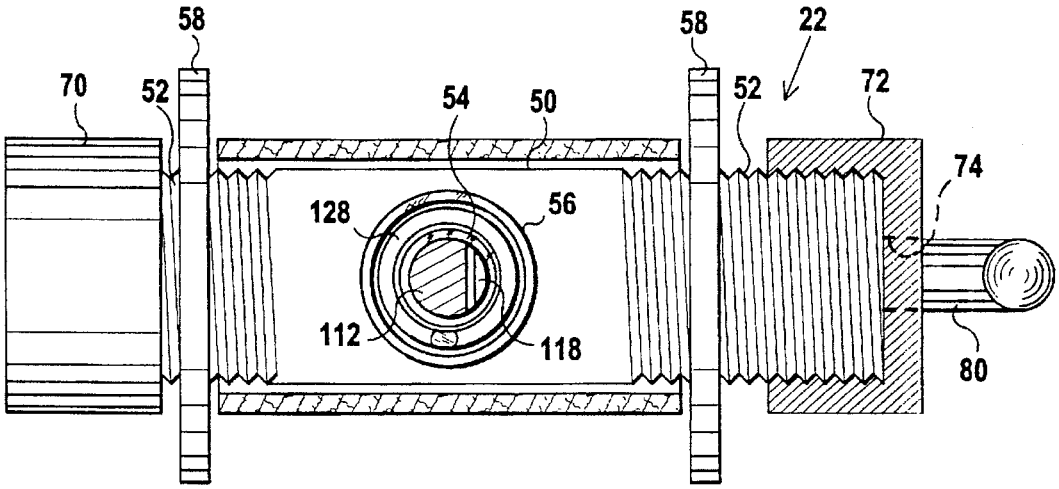
FIG. 5 is a diagrammatic top plan view of the crossbar containing the locking device assembly in partial cross section and with parts broken away taken on line 5—5 in FIG. 4.

As shown in FIG. 5, the locking device assembly pull handle rectangular-parallelepiped-shaped lock block 110 of the locking device assembly T-shaped pull handle 80 of the locking device assembly 22 is alignable and engagable with the locking device assembly substantially closed end cap rectangular-shaped throughbore 76 of the locking device assembly substantially closed and internally-threaded end cap 72 of the locking device assembly 22 so as to be selectively engagable therein.

Figure 11:
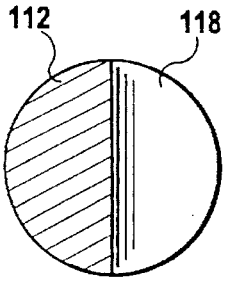
FIG. 11 is a cross sectional view of a preferred embodiment of the rack assembly having a circular cross section taken on line 11—11 in FIG. 4.

The configuration of the rack assembly 24 can best be seen in FIGS. 4, 11, and 12, and as such, will be discussed with reference thereto.

The rack assembly 24 includes a rack assembly rack 112 that has a rack assembly rack upper end 114 and a rack assembly rack lower end 116. As shown in FIG. 11, the rack assembly rack 112 of the rack assembly 24 is preferably made from a 9/16" dia. course grade cylindrical rod.

The rack assembly rack 112 of the rack assembly 24 has a plurality of rack assembly rack longitudinally-disposed, adjacently-positioned, collinear, and triangular-shaped teeth 118 that are cut into its outer surface and that extend along the longitudinal axis of the rack assembly rack 112 of the rack assembly 24 from the rack assembly rack upper end 114 of the rack assembly rack 112 of the rack assembly 24 to the rack assembly rack lower end 116 of the rack assembly rack 112 of the rack assembly 24.

Each of the plurality of rack assembly rack longitudinally-disposed, adjacently-positioned, collinear, and triangular-shaped teeth 118 of the rack assembly rack 112 of the rack assembly 24 is 1" high and has a rack assembly rack tooth laterally-oriented and straight lower edge 120 and a rack assembly rack tooth downwardly-and-outwardly slanting and straight side edge 122 that extends from the rack assembly rack 112 of the rack assembly 24 to the free end of the rack assembly rack tooth laterally-oriented and straight lower edge 120 of the plurality of rack assembly rack longitudinally-disposed, adjacently-positioned, collinear, and triangular-shaped teeth 118 of the rack assembly rack 112 of .the rack assembly 24.

The rack assembly rack 112 of the rack assembly 24 extends through the locking device assembly cylindrically-shaped retainer collar 56 of the locking device assembly 22 and the locking device assembly pipe centrally-disposed and laterally-oriented throughbore 54 of the 1" locking device assembly hollow generally cylindrically-shaped pipe 50 of the locking device assembly 22 with the plurality of rack assembly rack longitudinally-disposed, adjacently-positioned, collinear, and triangular-shaped teeth 118 of the rack assembly rack 112 of the rack assembly 24 facing the locking device assembly stopper Slide bar assembly 78 of the locking device assembly 22.

The rack assembly 24 further includes a rack assembly spring stop plate 124 that is disposed on the rack assembly rack upper end 114 of the rack assembly rack 112 of the rack assembly 24.

The rack assembly spring stop plate 124 of the rack assembly 24 is 1.5" long, 5/8" wide, and 3/8" high and has a rack assembly spring stop plate lower surface cylindrically-shaped retainer collar 126 that extends downwardly from the center of the lower surface of the rack assembly spring stop plate 124 of the rack assembly 24.

As shown in FIGS. 4 and 5, the rack assembly 24 further includes a rack assembly special spring 128 that surrounds the rack assembly rack 112 of the rack assembly 24 and has a rack assembly spring upper end 130 that sits in the rack assembly spring stop plate lower surface cylindrically-shaped retainer collar 126 of the rack assembly spring stop plate 124 of the rack assembly 24 and a rack assembly spring lower end 132 that sits in the locking device assembly cylindrically-shaped retainer collar 56 of the locking device assembly 22, so that the rack assembly rack 112 of the rack assembly 24 and the locking device assembly 22 are biased relative to each other.

Figure 12:
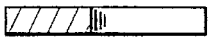
FIG. 12 is a cross sectional view of an alternate embodiment of the rack assembly having a rectangular cross section taken on line 12—12 in FIG. 4.

As shown in FIG. 12, the rack assembly rack 112 can also be made from a slender, elongated, and rectangular-parallelepiped-shaped saw blade stock material.

The operation of the extendable stirrup 10 can best be seen in FIG. 4, and as such, will be discussed with reference thereto.

The pair of locking device assembly retainer ring allen screws 66 of the locking device assembly 22 are loosened by use of the allen key 68.

The pair of locking device assembly internally-threaded retainer rings 58 of the locking device assembly 22 are threaded outwardly along the pair of locking device assembly pipe externally-threaded and open ends 52 of the 1" locking device assembly hollow generally cylindrically-shaped pipe 50 of the locking device assembly 22.

The saddle stirrup strap hole 28 of the conventional saddle stirrup leather strap 12 of the conventional saddle 14 is put in the conventional saddle stirrup leather strap 12 of the conventional saddle 14.

The conventional saddle stirrup leather strap free end 30 of the conventional saddle stirrup leather strap 12 of the conventional saddle 14 is wrapped around the 1" locking device assembly hollow generally cylindrically-shaped pipe 50 of the locking device assembly 22 with the rack assembly rack 112 of the rack assembly 24 extending downwardly through the saddle stirrup strap hole 28 of the conventional saddle stirrup leather strap 12 of the conventional saddle 14.

The retention ring 32 is attached to maintain the conventional saddle stirrup leather strap free end 30 of the conventional saddle stirrup leather strap 12 of the conventional saddle 14 against the conventional saddle stirrup leather strap 12 of the conventional saddle 14 while maintaining the locking device assembly 22 therebetween.

The pair of locking device assembly internally-threaded retainer rings 58 of the locking device assembly 22 are threaded inwardly along the pair of locking device assembly pipe externally-threaded and open ends 52 of the 1" locking device assembly hollow generally cylindrically-shaped pipe 50 of the locking device assembly 22 until they abut against the conventional saddle stirrup leather strap 12 of the conventional saddle 14.

The pair of locking device assembly retainer ring allen screws 66 of the locking device assembly 22 are tightened by use of the allen key 68, so that the pair of locking device assembly internally-threaded retainer rings 58 of the locking device assembly 22 are prevented from further threading and the conventional saddle stirrup leather strap 12 of the conventional saddle 14 is prevented against lateral movement.

Figure 3A:
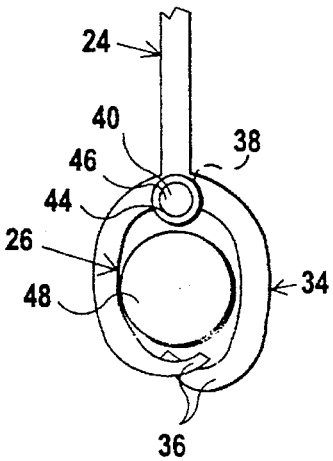
FIG. 3A is an enlarged diagrammatic side elevational view of the area enclosed by the dotted circle identified by arrow 3A in FIG. 3 and illustrating the manner in which the stirrup assembly is attached to the extendable stirrup.
Figure 3:
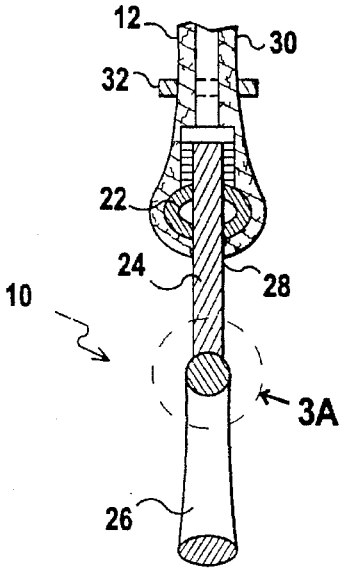
FIG. 3 is a partial cross sectional view taken on line 3—3 in FIG. 2 and illustrating the interaction of the extendable stirrup with the stirrup leather.

The rack assembly rack lower end 116 of the rack assembly rack 112 of the rack assembly 24 is passed through the 19/32" band centrally-disposed throughbore 38 of the 2" wide tough steel band 34 (see FIG. 3A).

The 2" wide tough steel band 34 is wrapped around the stirrup assembly crossbar 48 of the stirrup assembly 26 with the stirrup assembly crossbar 48 of the stirrup assembly 26 in substantial abutment with the pair of 5/8" O.D. rack assembly support bar ring keepers 44 of the 3/16" dia. rack assembly cylindrically-shaped support bar 40 of the rack assembly 24 (see FIG. 3A).

The band interlocking free ends 36 of the 2" wide tough steel band 34 are interlocked, so that the stirrup assembly crossbar 48 of the stirrup assembly 26 is maintained in substantial abutment with the pair of 5/8" O.D. rack assembly support bar ring keepers 44 of the 3/16" dia. rack assembly cylindrically-shaped support bar 40 of the rack assembly 24 while the pair of 5/8" O.D. rack assembly support bar ring keepers 44 of the rack assembly 24 reduce the relative lateral movement between the 2" wide tough steel band 34 and the rack assembly 24 (see FIG. 3A).

The locking device assembly T-shaped pull handle 80 of the locking device assembly 22 is pulled outwardly, against the biasing of the locking device assembly straight coil spring 82 of the locking device assembly 22, and causes the locking device assembly pull handle rectangular-parallelepiped-shaped lock block 110 of the locking device assembly T-shaped pull handle 80 of the locking device assembly 22 to leave the locking device assembly substantially closed end cap rectangular-shaped throughbore 76 of the locking device assembly substantially closed and internally-threaded end cap 72 of the locking device assembly 22 and thereby causing the locking device assembly stopper slide bar assembly main portion horizontal part front edge pawl 85 of the front edge of the locking device assembly stopper slide bar assembly main portion horizontal part 86 of the locking device assembly stopper slide bar assembly T-shaped main portion 84 of the locking device assembly stopper slide bar assembly 78 of the locking device assembly 22 to disengage with a respective tooth of the plurality of rack assembly rack longitudinally-disposed, adjacently-positioned, collinear, and triangular-shaped teeth 118 of the rack assembly rack 112 of the rack assembly 24.

The locking device assembly T-shaped pull handle 80 of the locking device assembly 22 is rotated, in the direction of a locking device assembly T-shaped pull handle rotation release arrow 134 (see FIG. 10), until the locking device assembly pull handle rectangular-parallelepiped-shaped lock block 110 of the locking device assembly T-shaped pull handle 80 of the locking device assembly 22 clears the locking device assembly substantially closed end cap rectangular-shaped throughbore 76 of the locking device assembly substantially closed and internally-threaded end cap 72 of the-locking device assembly 22 and rests on the locking device assembly substantially closed and internally-threaded end cap 72 of the locking device assembly 22, so that the rack assembly rack 112 of the rack assembly 24 is free to move relative to the locking device assembly 22.

The stirrup assembly 26, with the rack assembly 24 attached thereto, is moved upwardly towards or downwardly from the locking device assembly 22, against the biasing of the rack assembly special spring 128 of the rack assembly 24, until the desired height of the stirrup assembly 26 is achieved.

The locking device assembly T-shaped pull handle 80 of the locking device assembly 22 is rotated, in the direction of a locking device assembly T-shaped pull handle releasing rotation lock arrow 136 (see FIG. 10), until the locking device assembly pull handle rectangular-parallelepiped-shaped lock block 110 of the locking device assembly T-shaped pull handle 80 of the locking device assembly 22 enters the locking device assembly substantially closed end cap rectangular-shaped throughbore 76 of the locking device assembly substantially closed and internally-threaded end cap 72 of the locking device assembly 22.

The entry of the locking device assembly pull handle rectangular-parallelepiped-shaped lock block 110 of the locking device assembly T-shaped pull handle 80 of the locking device assembly 22 into the locking device assembly substantially closed end cap rectangular-shaped throughbore 76 of the locking device assembly substantially closed and internally-threaded end cap 72 of the locking device assembly 22 causes, by way of the biasing of the locking device assembly straight coil spring 82 of the locking device assembly 22, the locking device assembly stopper slide bar assembly main portion horizontal part front edge pawl 85 of the front edge of the locking device assembly stopper slide bar assembly main portion horizontal part 86 of the locking device assembly stopper slide bar assembly T-shaped main portion 84 of the locking device assembly stopper slide bar assembly 78 of the locking device assembly 22 to engage with a respective tooth of the plurality of rack assembly rack longitudinally-disposed, adjacently-positioned, collinear, and triangular-shaped teeth 118 of the rack assembly rack 112 of the rack assembly 24, so that relative movement between the stirrup assembly 26 and the locking device assembly 22 is prevented.

It will be understood that each of the elements described above, or two or more together, may also find a useful application in other types of constructions differing from the types described above.

While the invention has been illustrated and described as embodied in an extendable stirrup, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An extendable stirrup attachable to a conventional stirrup strap of a conventional saddle that has a free end and a throughbore disposed in proximity to the free end of the conventional stirrup strap of the conventional saddle, comprising:

a) a locking device assembly being attachable to the conventional stirrup strap of the conventional saddle;

b) a rack assembly having a lower end and being lockingly extendable from, and lockingly retractable in said locking device assembly;

c) a stirrup assembly being pivotally mounted to said lower end of said rack assembly, so that said stirrup assembly can be lowered and raised to adjust for different height equestrians; and d) a stirrup assembly mounting, means including a band that has a pair of interlocking free ends and a centrally-disposed throughbore that is disposed midway said pair of interlocking free ends of said band of said stirrup assembly mounting means; said stirrup assembly mounting means further includes a cylindrically-shaped support bar that has an upper portion and extends transversely outwardly from said lower end of said rack assembly and has a pair of ring keepers that are disposed in proximity to a pair of free ends of said cylindrically-shaped support bar of said rack assembly; said rack assembly extends through said centrally-disposed throughbore of said band of said stirrup assembly mounting means with said band of said stirrup assembly mounting means covering said upper portion of said cylindrically-shaped support bar of said rack assembly; said band of said stirrup assembly mounting means is wrapped around a crossbar of said stirrup assembly with said crossbar of said stirrup assembly in substantial abutment with said pair of ring keepers of said cylindrically-shaped support bar of said rack assembly; said interlocking free ends of said band of said stirrup assembly mounting means are interlocked, so that said crossbar of said stirrup assembly is maintained in substantial abutment with said pair of ring keepers of said cylindrically-shaped support bar of said assembly while said pair of ring keepers of said cylindrically-shaped support bar of said rack assembly reduce relative lateral movement between said band of said stirrup assembly mounting means and said rack assembly.

2. The stirrup as defined in claim 1, further comprising extendable stirrup mounting means for mounting said extendable stirrup to the conventional stirrup strap of the conventional saddle.

3. The stirrup as defined in claim 2, wherein said extendable stirrup mounting means includes a retention ring for maintaining the free end of the conventional stirrup strap of the conventional saddle against the conventional stirrup strap of the conventional saddle with said locking device assembly disposed therebetween, so that said retention ring can maintain said locking device assembly between said free end of said conventional stirrup strap of said conventional saddle and said conventional stirrup strap of said conventional saddle.

4. The stirrup as defined in claim 1, wherein said locking device assembly includes a hollow generally cylindrically-shaped pipe with a pair of externally-threaded and open ends and a centrally-disposed and laterally-oriented throughbore that passes laterally through said hollow generally cylindrically-shaped pipe of said locking device assembly midway between said pair of externally-threaded and open ends of said hollow generally cylindrically-shaped pipe of said locking device assembly.

5. The stirrup as defined in claim 4, wherein said locking device assembly further includes a cylindrically-shaped retainer collar that extends normally outwardly from said centrally-disposed and laterally-oriented throughbore of said hollow generally cylindrically-shaped pipe of said locking device assembly.

6. The stirrup as defined in claim 5, wherein said locking device assembly further includes a pair of internally-threaded retainer rings; each of said pair of internally-threaded retainer rings of said locking-device assembly has an outer perimeter and a threaded inner perimeter which threadably engages a respective end of said pair of externally-threaded and open ends of said hollow generally cylindrically-shaped pipe of said locking device assembly; each of said pair of internally-threaded retainer rings of said locking device assembly has a radially-oriented and threaded throughbore that extends from said outer perimeter of each of said pair of internally-threaded retainer rings of said locking device assembly to said threaded inner perimeter of a respective ring of said pair of internally-threaded retainer rings of said locking device assembly; said locking device assembly further includes a pair of allen screws; each of said pair of allen screws of said locking device assembly threadably engages said radially-oriented and threaded throughbore of a respective ring of said pair of internally-threaded retainer rings of said locking device assembly, so that relative movement between said pair of internally-threaded retainer rings of said locking device assembly and said hollow generally cylindrically-shaped pipe of said locking device assembly is prevented by said pair of allen screws of said locking device assembly contacting said hollow generally cylindrically-shaped pipe of said locking device assembly.

7. The stirrup as defined in claim 6, wherein said locking device assembly further includes a closed and internally-threaded end cap that replaceably threadably engages one end of said pair of externally-threaded and open ends of said hollow generally cylindrically-shaped pipe of said locking device assembly with one ring of said pair of internally-threaded retainer rings of said locking device assembly disposed between said closed and internally-threaded end cap of said locking device assembly and said cylindrically-shaped retainer collar of said locking device assembly, so that injury to a user from exposed threads of said one end of said pair of externally-threaded and open ends of said hollow generally cylindrically-shaped pipe of said locking device assembly is prevented and internal components of said locking device assembly can be easily serviced.

8. The stirrup as defined in claim 6, wherein said locking device assembly further includes a substantially closed and internally-threaded end cap that has a center and replaceably threadably engages another end of said pair of externally-threaded and open ends of said hollow generally cylindrically-shaped pipe of said locking device assembly with another ring of said pair of internally-threaded retainer rings of said locking device assembly disposed between said substantially closed and internally-threaded end cap of said locking device assembly and said cylindrically-shaped retainer collar of said locking device assembly, so that injury to a user from exposed threads of said another end of said pair of externally-threaded and open ends of said hollow generally cylindrically-shaped pipe of said locking device assembly is prevented and internal components of said locking device assembly can be easily serviced; said substantially closed and internally-threaded end cap of said locking device assembly has a centrally-disposed, axially-oriented, and circular-shaped throughbore that extends axially through said center of said substantially closed end cap of said locking device assembly.

9. The stirrup as defined in claim 8, wherein said substantially closed and internally-threaded end cap of said locking device assembly further has a rectangular-shaped throughbore that extends radially outwardly from, and opens into, said centrally-disposed, axially-oriented, and circular-shaped throughbore of said substantially closed and internally-threaded end cap of said locking device assembly.

10. The stirrup as defined in claim 9, wherein said locking device assembly further includes a stopper slide bar assembly that is movably contained in said hollow generally cylindrically-shaped pipe of said locking device assembly in proximity to said substantially closed and internally-threaded end cap of said locking device assembly.

11. The stirrup as defined in claim 10, wherein said locking device assembly further includes a T-shaped pull handle that extends through said centrally-disposed, axially-oriented, and circular-shaped throughbore of said substantially closed and internally-threaded end cap of said locking device assembly and engages said stopper slide bar assembly of said locking device assembly.

12. The stirrup as defined in claim 11, wherein said locking device assembly further includes a coil spring which is disposed in said hollow generally cylindrically-shaped pipe of said locking device assembly, around said T-shaped pull handle of said locking device assembly, and biases said stopper slide bar assembly of said locking device assembly away from said substantially closed and internally-threaded end cap of said locking device assembly.

13. The stirrup as defined in claim 11, wherein said stopper slide bar assembly of said locking device assembly includes a T-shaped main portion with a horizontal part that has an upper surface, a lower surface, a rear edge, a front edge, and a longitudinal axis; said T-shaped main portion of said stopper slide bar assembly of said locking device assembly further has a vertical stem part that has a front edge and a rear edge and extends downwardly from-said lower surface of, and along said longitudinal axis of, said horizontal part of said T-shaped main portion of said stopper slide bar assembly of said locking device assembly; said rear edge of said vertical stem part of said T-shaped main portion of said stopper slide bar assembly of said locking device assembly is flush with said rear edge of said horizontal part of said T-shaped main portion of said stopper slide bar assembly of said locking device assembly; said front edge of said vertical stem part of said T-shaped main portion of said stopper slide bar assembly of said locking device assembly terminates rearward of said front edge of said horizontal part of said T-shaped main portion of said stopper slide bar assembly of said locking device assembly so as to form a front edge pawl that forms said front edge of said horizontal part of said T-shaped main portion of said stopper slide bar assembly of said locking device assembly.

14. The stirrup as defined in claim 13, wherein said stopper slide bar assembly of said locking device assembly further includes a substantially C-shaped pull handle part that has an upper horizontally-oriented element with a free end which is centered on said upper surface of said horizontal part of said T-shaped main portion of said stopper slide bar assembly of said locking device assembly and rearward of said front edge thereof; said horizontally-oriented element of said substantially C-shaped pull handle part of said stopper slide bar assembly of said locking device assembly is slightly upwardly offset relative to said upper surface of said horizontal part of said T-shaped main portion of said stopper slide bar assembly of said locking device assembly and extends rearwardly past said rear edge of said horizontal part of said T-shaped main portion of said stopper slide bar assembly of said locking device assembly; said substantially C-shaped pull handle part of said stopper slide bar assembly of said locking device assembly further has a vertically-oriented element that extends normally downwardly at one end from another end of said upper horizontally-oriented element of said substantially C-shaped pull handle part of said stopper slide bar assembly of said locking device assembly; said vertically-oriented element of said substantially C-shaped pull handle part of said stopper slide bar assembly of said locking device assembly has a centrally-disposed throughbore that is in substantial alignment with said rear edge of said horizontal part of said T-shaped main portion of said stopper slide bar assembly of said locking device assembly; said C-shaped pull handle part of said stopper slide bar assembly of said locking device assembly further has a lower horizontally-oriented element that extends at one end normally forwardly from another end of said vertically-oriented element of said substantially C-shaped pull handle part of said stopper slide bar assembly of said locking device assembly and terminates in a slotted free end that has an axially-oriented and centrally-disposed throughslot that receives said vertical stem part of said T-shaped main portion of said stopper slide bar assembly of said locking device assembly.

15. The stirrup as defined in claim 14, wherein said T-shaped pull handle of said locking device assembly includes a shaft portion with an externally-threaded free distal end and a proximal end which an arm portion that extends normally outwardly therefrom; said T-shaped pull handle of said locking device assembly further includes an internally-threaded stop that is threadably engaged to said externally-threaded free distal end of said shaft portion of said T-shaped pull handle of said locking device assembly and a a rectangular-parallelepiped-shaped lock block that is disposed on said shaft portion of said T-shaped pull handle of said locking device assembly, in proximity to said arm portion of said T-shaped pull handle of said locking device assembly; said externally-threaded free distal end of said shaft portion of said T-shaped pull handle of said locking device assembly passes movably through said centrally-disposed throughbore of said vertically-oriented element of said substantially C-shaped pull handle part of said stopper slide bar assembly of said locking device assembly with said internally threaded stop of said T-shaped pull handle of said locking device assembly threaded thereon and positioned between said vertically-oriented element of said substantially C-shaped pull handle part of said stopper slide bar assembly of said locking device assembly and said rear edge of said horizontal part of said T-shaped main portion of said stopper slide bar assembly of said locking device assembly and in alignment therewith; said rectangular-parallelepiped-shaped lock block of said T-shaped pull handle of said locking device assembly is alignable and engagable with said rectangular-shaped throughbore of said substantially closed and internally-threaded end cap of said locking device assembly so as to be selectively engagable therein.

16. The stirrup as defined in claim 10, wherein said rack assembly includes an elongated and cylindrically-shaped rack that has an outer surface, an upper end, a lower end, and a plurality of longitudinally-disposed, adjacently-positioned, collinear, and triangular-shaped teeth that extend outwardly from said outer surface of said elongated and cylindrically-shaped rack of said rack assembly from said upper end of said elongated and cylindrically-shaped rack of said rack assembly to said lower end of said elongated and cylindrically-shaped rack of said rack assembly; each of said plurality of longitudinally-disposed, adjacently-positioned, collinear, and triangular-shaped teeth of said outer surface of said elongated and cylindrically-shaped rack of said rack assembly has a laterally-oriented and straight lower edge and a downwardly-and-outwardly slanting and straight side edge that extends from said outer surface of said elongated and cylindrically-shaped rack of said rack assembly to a free end of said laterally-oriented and straight lower edge of said plurality of longitudinally-disposed, adjacently-positioned, collinear, and triangular-shaped teeth of said outer surface of said elongated and cylindrically-shaped rack of said rack assembly; said elongated and cylindrically-shaped rack of said rack assembly extends through said cylindrically-shaped retainer collar of said locking device assembly and said centrally-disposed and laterally-oriented throughbore of said hollow generally cylindrically-shaped pipe of said locking device assembly with said plurality of longitudinally-disposed, adjacently-positioned, collinear, and triangular-shaped teeth of said outer surface of said, elongated and cylindrically-shaped rack of said rack assembly facing said stopper slide bar assembly of said locking device assembly.

17. The stirrup as defined in claim 16, wherein said rack assembly further includes a stop plate that is disposed on said upper end of said elongated and cylindrically-shaped rack of said rack assembly and has a lower surface with a cylindrically-shaped retainer collar that extends downwardly from said lower surface of said stop plate of said rack assembly.

18. The stirrup as defined in claim 17, wherein said rack assembly further includes a spring that surrounds said elongated and cylindrically-shaped rack of said rack assembly and has an upper end that sits in said cylindrically-shaped retainer collar of said lower surface of said stop plate of said rack assembly and a lower end that sits in said cylindrically-shaped retainer collar of said locking device assembly, so that said elongated and cylindrically-shaped rack of said rack assembly and said locking device assembly are biased relative to each other.

19. The stirrup as defined in claim 10, wherein said rack assembly includes a slender, elongated, and rectangular-parallelepiped-shaped rack.

20. A method of using an extendable stirrup for assisting equestrians of different heights to mount a horse, comprising the steps of:

a) loosening a pair of allen screws of a pair of internally-threaded retainer rings of a locking device assembly of said extendable stirrup;

b) threading said pair of internally-threaded retainer rings of said locking device assembly outwardly along a pair of externally-threaded and open ends of a hollow generally cylindrically-shaped pipe of said locking device assembly;

c) putting a hole in a conventional stirrup strap of a conventional saddle;

d) wrapping a free end of the conventional stirrup strap around said hollow generally cylindrically-shaped pipe of said locking device assembly with an elongated and cylindrically-shaped rack of a rack assembly of said extendable stirrup extending downwardly through the hole in the conventional stirrup strap;

e) attaching a retention ring of said extendable stirrup to maintain the free end of the conventional stirrup strap against the conventional stirrup strap while maintaining said locking device assembly therebetween;

f) threading said pair of internally-threaded retainer rings of said locking device assembly inwardly along said pair of externally-threaded and open ends of said hollow generally cylindrically-shaped pipe of said locking device assembly until said pair of internally-threaded retainer rings of said locking device assembly generally abut against the conventional stirrup strap;

g) tightening said pair of allen screws of said pair of internally-threaded retainer rings of said locking device assembly, so that said pair of internally-threaded retainer rings of said locking device assembly are prevented from further threading and the conventional stirrup strap is prevented against lateral movement;

h) passing a lower end of said elongated and cylindrically-shaped rack of said rack assembly through a centrally-disposed throughbore of a band of said extendable stirrup;

i) wrapping said band around a crossbar of a stirrup assembly of said extendable stirrup with said crossbar of said stirrup assembly in substantial abutment with a pair of ring keepers of a cylindrically-shaped support bar of said rack assembly;

j) interlocking a pair of interlocking free ends of said band, so that said crossbar of said stirrup assembly is maintained in substantial abutment with said pair of ring keepers of said cylindrically-shaped support bar of said rack assembly while said pair of ring keepers of said cylindrically-shaped support bar of said rack assembly reduce relative lateral movement between said band and said rack assembly;

k) pulling outwardly a T-shaped pull handle of said locking device assembly against biasing of a spring of said locking device assembly;

l) causing a rectangular-parallelepiped-shaped lock block of said T-shaped pull handle of said locking device assembly to leave a rectangular-shaped throughbore of a substantially closed and internally-threaded end cap of said locking device assembly;

m) causing a front edge pawl of a front edge of a horizontal part of a T-shaped main portion of a stopper slide bar assembly of said locking device assembly to disengage with a respective tooth of a plurality of longitudinally-disposed, adjacently-positioned, collinear, and triangular-shaped teeth of an outer surface of said elongated and cylindrically-shaped rack of said rack assembly;

n) rotating said T-shaped pull handle of said locking device assembly until said rectangular-parallelepiped-shaped lock block of said T-shaped pull handle of said locking device assembly clears said rectangular-shaped throughbore of said substantially closed and internally-threaded end cap of said locking device assembly and rests on said substantially closed and internally-threaded end cap of said locking device assembly, so that said elongated and cylindrically-shaped rack of said rack assembly is free to move relative to said locking device assembly;

o) moving said stirrup assembly relative to said locking device assembly, against biasing of a spring of said rack assembly, until desired height of said stirrup assembly is achieved, so that equestrians of different heights are assisted in mounting the horse;

p) rotating said T-shaped pull handle of said locking device assembly until said rectangular-parallelepiped-shaped lock block of said T-shaped pull handle of said locking device assembly enters said rectangular-shaped throughbore of said substantially closed and internally-threaded end cap of said locking device assembly;

q) releasing said T-shaped pull handle of said locking device assembly; and r) engaging, by biasing of said spring of said locking device assembly, said front edge pawl of said front edge of said horizontal part of said T-shaped main portion of said stopper slide bar assembly of said locking device assembly with a respective tooth of said plurality of longitudinally-disposed, adjacently-positioned, collinear, and triangular-shaped teeth of said outer surface of said elongated and cylindrically-shaped rack of said rack assembly, so that relative movement between said stirrup assembly and said locking device assembly is prevented and the equestrian can use the stirrup assembly to mount the horse.

* * * * *